US005215074A

United States Patent [19]

Wilson et al.

[11] Patent Number: 5,215,074

[45] Date of Patent: Jun. 1, 1993

[54] LIFT-UP COOKTOP LOCATOR WITH COMBINED FUNCTION AS SUPPORT ROD RACE

[75] Inventors: Arthur C. Wilson; David L. Kinny; Ralph G. Hawkins, all of Louisville, Ky.

[73] Assignee: General Electric Company, Louisville, Ky.

[21] Appl. No.: 890,249

[22] Filed: May 29, 1992

[51] Int. Cl.[5] ..... F24C 5/10

[52] U.S. Cl. ..... 126/214 R; 126/211; 126/39 R; 126/39 B; 219/443; 292/338; 292/DIG. 56

[58] Field of Search ..... 126/214 R, 211, 214 A, 126/214 D, 39 R, 37 B, 39 N, 220; 292/338, 275, DIG. 56; 219/443, 444, 445, 464; 49/394, 322

[56] References Cited

U.S. PATENT DOCUMENTS

| | | | |
|---|---|---|---|
| 2,040,948 | 5/1936 | Moore et al. | 126/214 R |
| 2,962,319 | 11/1960 | North et al. | 292/275 |
| 3,004,132 | 10/1961 | Harris, Jr. et al. | 219/37 |
| 3,499,433 | 3/1970 | Payne | 126/211 |
| 3,959,859 | 6/1976 | Stein, Jr. | 292/338 |
| 4,869,231 | 9/1989 | Rice et al. | 126/214 R |

*Primary Examiner*—James C. Yeung

*Attorney, Agent, or Firm*—H. Neil Houser; Radford M. Reams

[57] ABSTRACT

A range with a lift-up cooktop is provided with an integrally formed non-metallic combination cooktop locator and support rod race member to position the cooktop relative to the rang body when the lift-up cooktop is in its lowered position and to provide a non-metallic bearing surface for the support rod to slide against when the lift-up cooktop is raised and lowered.

11 Claims, 2 Drawing Sheets

LIFT-UP COOKTOP LOCATOR WITH COMBINED FUNCTION AS SUPPORT ROD RACE

BACKGROUND OF THE INVENTION

This invention relates to domestic range cooking appliances of the type having a lift-up cooktop to provide convenient access to the area beneath the cooktop for cleaning, and in particular to an improvement in the structure accommodating the support rod or rods which support the cooktop in its raised position.

Lift-top ranges of the type in which the cooktop portion of the range is pivotally mounted at the rear of the range for pivotal movement between a lowered or normal position in which the cooktop rests on the range body and a raised position in which the area beneath the cooktop is exposed and readily accessible for cleaning are well known in the art, as illustrated in U.S. Pat. No. 3,499,433 and commonly assigned U.S. Pat. No. 4,869,231.

Typically the cooktop is supported in its raised position by at least one metal support rod attached at one end to the cooktop with the free end extending through a slot in the top surface of the range body into a recess area within the range body. When the top is lifted the rod is partially withdrawn from the slot and snaps over the edge of the slot to support the cooktop in the raised position. Such appliances may also include a locator for positioning the cooktop relative to the range body when returned to its normal position. Typically the locator is provided in the form of a cylindrically shaped part attached to the either cooktop or the range body with a corresponding opening in the other part.

The prior art support rod arrangements perform the support function satisfactorily. However, since the rod is typically biased against the edge of the slot, metal to metal sliding contact occurs as the cooktop is moved between positions causing an annoying noise.

It is desirable to provide a solution to the noise problem without adding additional cost or complexity to the range structure.

The present invention satisfactorily solves the noise problem by providing a single integrally formed part which performs the locator function and also provides a relatively quiet non-metal bearing surface for the support rod to slide against effectively eliminating the noise resulting from the metal to metal friction characteristic of prior art support rod arrangements.

SUMMARY OF THE INVENTION

A range cooking appliance of the type having a lift-up cooktop pivotally supported from the range body for movement between a normal position and a raised position, and having at least one support rod for supporting the cooktop in its raised position, is provided with an integrally formed non-metallic combination locator and rod race member to position the cooktop relative to the range body when in its normal position and to provide a non-metallic bearing surface for the support rod. This member is supported from the range body and located proximate the rod receiving slot formed in the top surface of the range body. The member includes a vertically upwardly extending locator portion positioned in register with a corresponding locator opening formed in the cooktop for receiving said locator portion to laterally position the cooktop relative to the range body when in the normal position, and a rod race portion comprising a generally vertically extending bearing surface which extends downwardly through the rod receiving slot between the rod and the retaining edge of the slot for sliding engagement with the rod as the cooktop moves between its raised and normal positions.

Preferably the locator portion is laterally displaced relative to the race portion, with a generally planar web portion extending therebetween. Tab means spaced vertically downwardly from the web portion extends laterally from the bearing surface below the top surface of the range body and beyond the edge of the slot to limit upward movement of the race portion. The locator portion is suitably secured to the range body such as by a screw. A projection extends downwardly from the web portion to abuttingly engage the top surface between the locator portion and the race portion, urging the tab means upwardly into abutting engagement with the top surface thereby limiting relative vertical movement between the tab means and the top surface.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings, in which:

DETAILED DESCRIPTION OF THE PREFERRED EMBODIMENT

Figure 1:
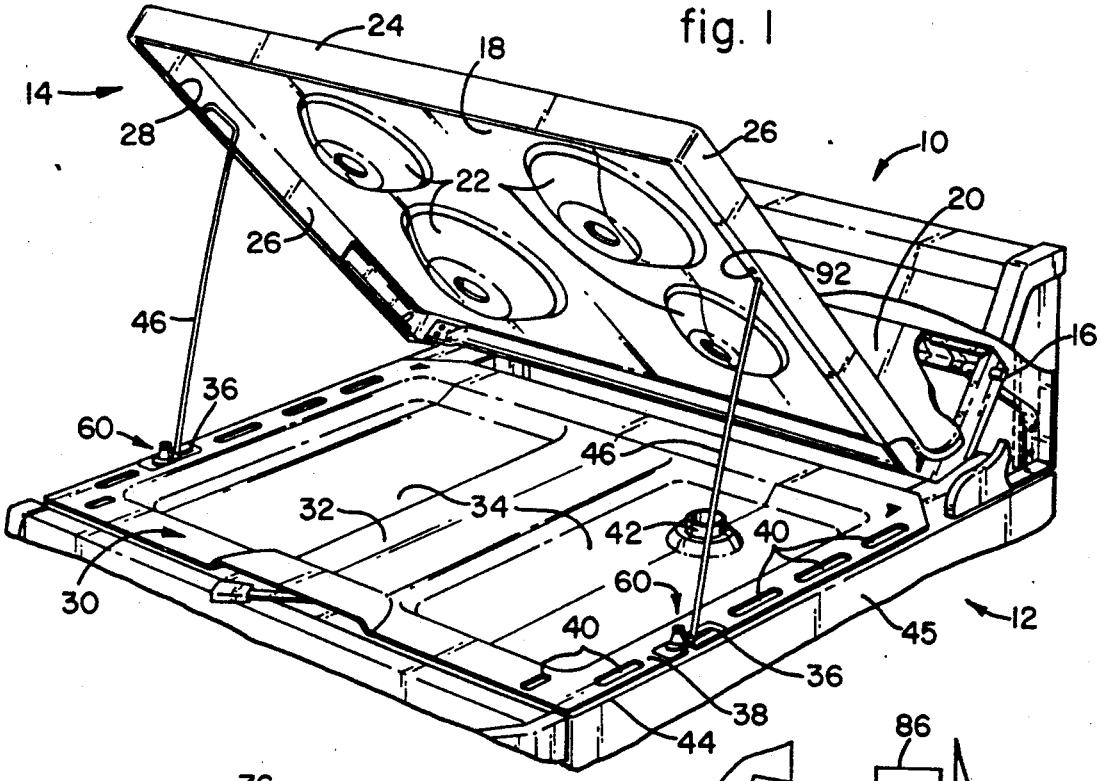
FIG. 1 is a front perspective view of the upper portion of a range with a pivotally mounted range top in its raised position, incorporating an illustrative embodiment of the locator and support rod race member of the present invention.

Referring to the drawings and particularly FIG. 1, there is shown for illustrative purposes, the upper portion of an electric range 10 comprising a range body designated generally 12 and a lift-up cooktop 14 pivotally mounted at 16 for pivotal movement between a normal or lowered position (partially shown in FIG.2) and a raised position as shown in FIG. 1. A more detailed description of the pivotal mounting arrangement and support structure for the cooktop is provided in commonly assigned co-pending U.S. patent application Ser. No. 07/993,957, filed Dec. 18, 1992, which is a continuation of Ser. No. 07/787,601 filed Nov. 4, 1991, now abandoned the disclosure of which is hereby incorporated by reference.

The cooktop 14, which is primarily an integrally formed sheet metal part, includes a cooking surface section 18, which is generally horizontal in its normal position, and an upwardly bent upswept section 20. The cooking surface section 18 of the cooktop 14 has a plurality of electrical heating elements (not shown) which are aligned with and supported over corresponding drip pans 22. The cooking surface section 18 is framed on three sides by a front wall 24 and two side walls 26, each of which has a inwardly extending return flange 28.

The top surface 30 of the range body 12 substantially comprises a sub-top member 32, which is sheet metal part formed provide two parallel spill containing tubs 34 running front to back beneath the burner drip pans 22. A rod receiving slot 36 is formed proximate each side edge 38 of the sub-top 32 near the front corners of the range body 12. A plurality of ventilating slots 40 are also formed along the side edges 38 of the sub-top 32 to permit convective cooling air flow from beneath the sub-top 32 to enter the area between the sub-top 32 and the cooktop 14. Exhaust gases exit the oven portion of the range 10 contained within the lower portion of the range body (not shown) via the chimney 42.

Figure 5:
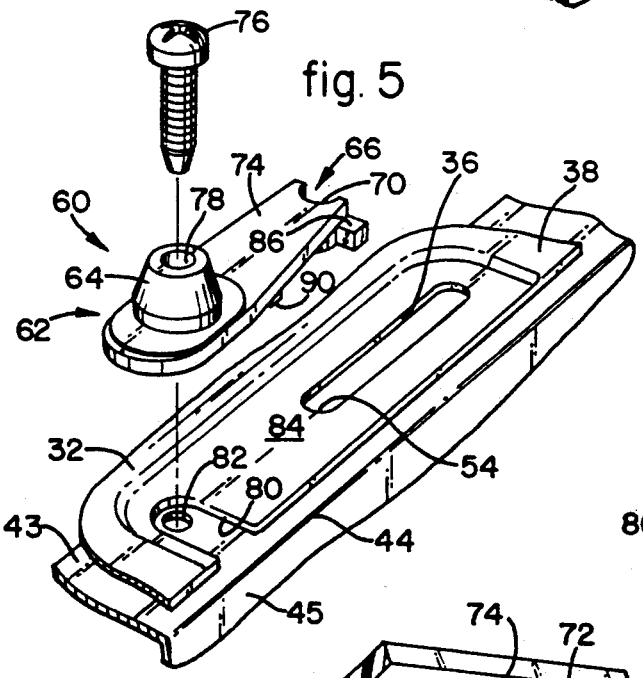
FIG. 5 is an exploded perspective view of locator and support rod assembly incorporated in the range of FIG. 1.
Figure 2:
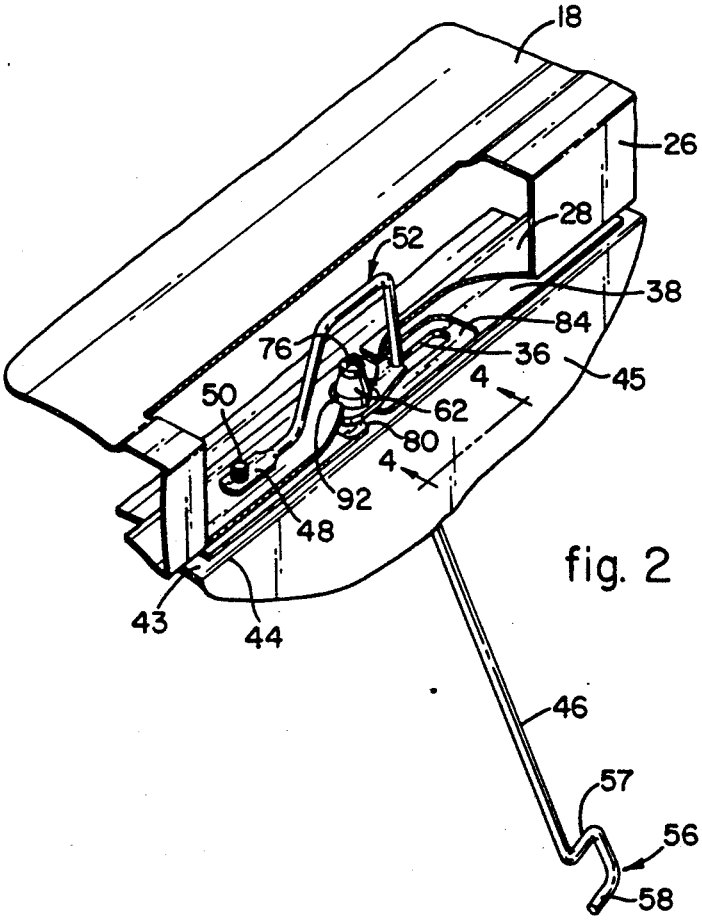
FIG. 2 is a front perspective view of a portion of the range of FIG. 1 showing the cooktop in its normal position with portions removed to show details of the support rod and the locator and support rod race member.
Figure 3:
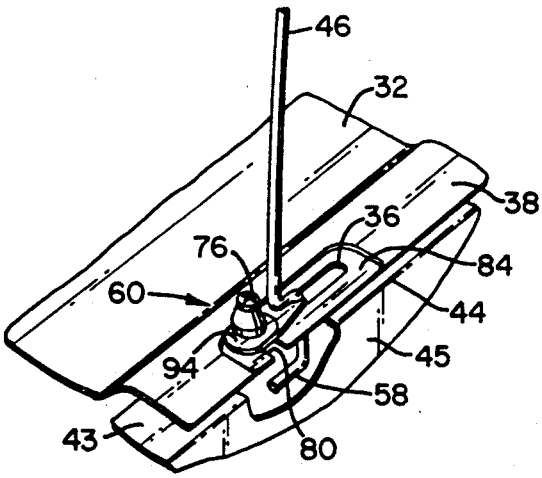
FIG. 3 is an enlarged front perspective view of a portion of the range of FIG. 1 with the cooktop in its raised position with portions removed to show details of the support rod and the locator and support rod race member.

As best seen in FIGS.2, 3 and 5, the sub-top 32 is supported proximate its side edges 38 by an inwardly extending top flange 43 formed along the upper edge 44 of each of the side walls 45 of the range body 12. The ventilating slots 40 formed along the side edges 38 (FIG. 1) of the sub-top 32 and the rod receiving slots 36 overlie corresponding slots (not shown) in the range sidewall top flange 45. The sub-top 32 is formed with a slight downward curvature along its side edges 38 to provide a close fit when secured to the sidewall top flange 43 by screws (not shown).

The cooktop 14 is supported in its raised position by two low carbon steel rods 46 mounted to the cooktop 14 proximate the front corners. As best seen in FIG. 2, each rod 46 has a flattened end 48 (FIG. 2) which is suitably secured to the reverse bent flange portion 28 of the corresponding cooktop side wall 26 such as by a screw 50. The bending angle at 52 (FIG. 2) biases each rod 46 forwardly toward the retaining edge 54 (FIG. 4) of its corresponding rod receiving slot 36. The free end 56 of each of the rods 46 is shaped in a forwardly facing square C shape. As the cooktop 14 approaches its raised position, the upper portion of the C is withdrawn from the slot 36 and automatically snaps forward to over the top surface of the range body proximate the retaining edge 54 of the slot 36, thereby holding the cooktop 14 in its raised position. The bottom portion 58 of the C prevents movement substantially beyond the desired raised position by catching the range body 12 proximate the slot 36 from below.

In accordance with the prior art, the rods 46 would merely slide in and out in sliding engagement with the retaining edge of the slot formed in the metal range body, the metal to metal friction causing an irritating noise.

In accordance with the present invention such metal to metal contact is prevented by the provision of a non-metal race or bearing surface interposed between the rod 46 and the retaining edge 54 of the slot 36. This bearing surface is provided by an integrally molded race member designated generally 60.

Figure 6:
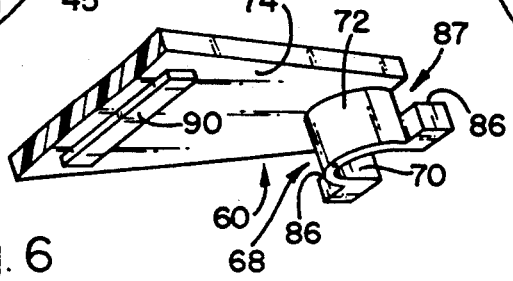
FIG. 6 is a fragmentary perspective bottom view of the race member of FIG. 5.
Figure 4:
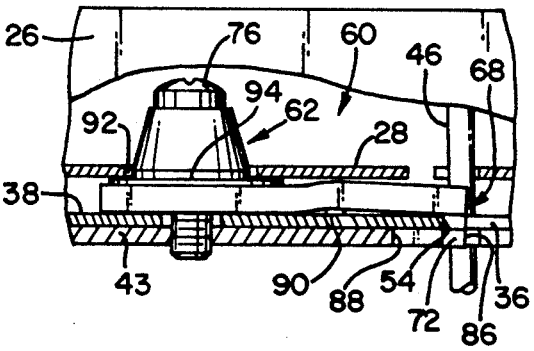
FIG. 4 is a side elevational view partially in section taken along lines 4—4 of FIG. 2.

The race member 60, as best seen in FIGS. 4, 5 and 6, comprises a vertically upwardly extending locator portion 62 formed generally in the shape of a truncated cone 64, and a race portion 66 comprising a vertically downwardly extending wall segment 68 comprising a bearing surface 70 curved to generally conform to the circumference of the support rod 46 and an outer surface 72 having a curvature which substantially conforms to the shape of the rod receiving slot 36 proximate the retaining edge 54. The race portion 66 is laterally displaced from the locator portion 62, with a generally planar web portion 74 extending therebetween.

The locator portion 62 of the race member 60 is securely attached to the range body 12 proximate each rod receiving slot 36 by suitable fastening means, which in the illustrative embodiment takes the form of a screw 76 extending through a central longitudinally extending concentric bore 78 formed in the truncated cone 64, and a side opening slot 80 formed in the sub-top 32 into a screw hole 82 formed in the top flange 44 of the range side wall 45. In order to provide a flat support surface for the race member 60, a flat depression 84 is formed in the sub-top 32 proximate the rod receiving slot 36. When the race member 60 is properly seated in the depression 84, the wall segment 68 of race portion 66 extends vertically downwardly through the slot 36 with the outer surface 72 abutting the retaining edge 54 of the slot 36.

Upward movement of the wall segment 68 is limited by tab means which in the illustrative are provided in the form of tabs 86 which are spaced vertically downwardly from the web portion 74 and project laterally from the lower extent of wall segment 68 of race portion 66. The vertical spacing at 87 between the web portion 74 and the tabs 86 must at least be slightly greater than the thickness of the sub-top 32 surrounding the rod receiving slot 36. When fully assembled the tabs 86 are disposed below the level of the sub-top 32 and extend laterally beneath the side edges of the slot 36 to capture the sub-top 32 between the web portion 74 and the tabs 86. Upward movement of the race portion 66 is limited by abutting engagement between the tabs 86 and the bottom surface of the sub-top 32. The corresponding slotted opening in the side wall top flange 44 (partially illustrated at 88 in FIG. 4) which underlies the rod receiving slot 36 is substantially wider than the rod receiving slot 36 so that the flange 44 does not obtsruct the tabs 86.

Figure 7:
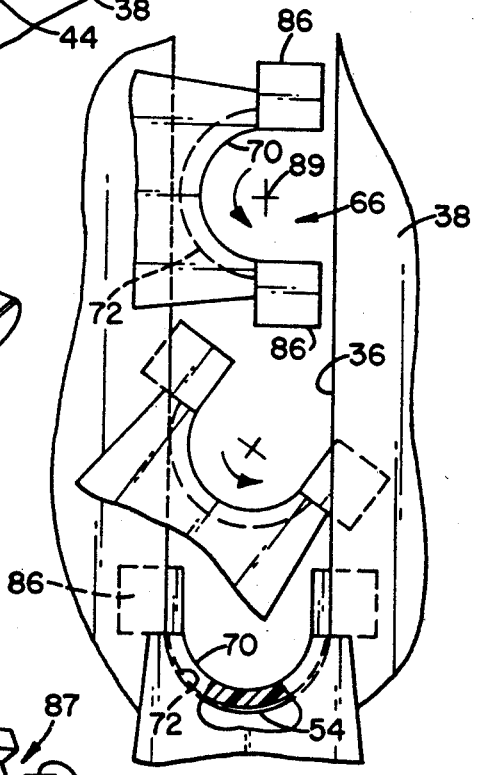
FIG. 7 is a top plan view of a portion of the range of FIG. 1 illustrating the insertion of the rod race portion of the locator and rod race member in the rod receiving slot.

As illustrated in FIG. 7, the race member 60 is attached to the range body 12 by initially positioning the race member 60 perpendicular to the rod receiving slot 36 as shown at 89, with the race portion 66 extending downwardly through the slot 36 to position the tabs 86 below the sub-top 32, then rotating the race member 60 counterclockwise into longitudinal alignment with slot 36 and sliding it toward the front of the range body 12 until the outer surface 72 of wall segment 68 abuts the retaining edge 54 of the slot 36. In this position the tabs 86 are disposed below the sub-top 32 and extend laterally beneath the sub-top 32 to limit vertical upward movement of the race portion 66. However, for ease of assembly and to allow for manufacturing tolerances the vertical gap between the tabs 86 and the web portion 74 is intentionally oversized relative to the thickness of the sub-top 32 surrounding the slot 36. The play permitted by this relatively loose fit may result in noisy vibration when the support rod 46 slides on the bearing surface 70.

To prevent such vibration noise in accordance with another aspect of the invention, a projection 90 is formed extending generally transverse to the length of and downwardly from the web portion 74 preferably intermediate the locator portion 62 and the race portion 66, to abuttingly engage the sub-top 32. As best seen in FIG. 4, as the locator portion 62 is securely attached by tightening the screw 76, the projection 90 provides a pivot point and the tabs 86 are urged upwardly by lever action into abutting engagement with the bottom surface of the sub-top 32 proximate the slot 36, introducing a slight bow in the web portion 74 of race member 60. The height and lateral placement of the projection 90 are empirically selected to urge the tabs 86 against the sub-top 32 with sufficient upward force to at least counteract the friction force applied to the bearing surface 70 by the sliding action of rod 46 so as to effectively prevent movement of the race portion 66 relative to the sub-top 32.

Regarding the locator function performed by the race member 60, a locator hole 92 (FIGS. 2 and 4) is formed in the inwardly extending flange 28 of cooktop 14 in register with the screw hole 82 formed in the range sidewall top flange 44 for attaching race member 60. When fully assembled, the locator portion 62 of the race member 60 is then in register with the locator hole 92. When the cooktop 14 is lowered to its normal position, the locator portion 62 is received in the locator hole 92 to laterally position the cooktop 14 relative to the range body 12.

Vertical spacing of the cooktop 14 relative to the range body 12 is also assisted by the race member 60. In particular vertical locator means is provided in the form of a flat 94 formed about the periphery of the base of the truncated cone 64. The cooktop flange 28 surrounding the locator hole 92 rests on this flat 94 when the cooktop 14 is in its normal position. Consequently the thickness of the flat 94, which is greater than the thickness of the web portion 74, establishes the vertical spacing between the cooktop 14 and the range body 12 when the cooktop 14 is in its normal position.

In the illustrative embodiment the race member 60 is formed of a heat stabilized nylon material commonly referred to as type 66, such as for example, Nylon 1003-2, available commercially from Celanese Corporation. Other suitable materials could be similarly used provided they are capable of withstanding temperatures on the order of 200 degrees Fahrenheit without deforming or otherwise compromising structural integrity over the life of the range.

While a specific embodiment of the present invention has been illustrated and described herein, it is realized that modifications and changes will occur to those skilled in the art to which the invention pertains. For example, the embodiment herein described illustrates use of the invention in an electric range equipped with a pair of support rods. However, it will be appreciated that advantageous of the invention is not limited to such appliances. For example it could be similarly employed in gas ranges as well. Also it could be similarly employed in such appliances equipped with a single support rod. It is therefore to be understood that the appended claims are intended to cover all such modifications and changes as fall within the true spirit and scope of the invention.

What is claimed is:

1. In a range cooking appliance defining a range body and of the type having a lift-up cooktop pivotally supported from the range body for movement between a normal position and a raised position, and having at least one support rod for supporting the cooktop in its raised position, which rod is attached at one end to the cooktop, the range body including a top surface extending beneath the cooktop with a slot formed therein to receive the free end of the support rod which rod extends through the slot into a recess area within the range body, the rod being biased toward a retaining edge of the slot to releasably supportingly engage the range body proximate the retaining edge of the slot when the cooktop is in its raised position, the improvement comprising:

an integrally formed locator and support rod race member supported from the range body proximate the rod receiving slot formed therein, said member comprising a vertically upwardly extending locator portion positioned in register with a corresponding locator opening formed in the cooktop for receiving said locator portion to laterally position the cooktop relative to the range body when in the normal position, and a race portion comprising a generally vertically extending bearing surface which extends downwardly through the rod receiving slot between the rod and the retaining edge of the slot for sliding engagement with the rod as the cooktop moves between its raised and normal positions.

2. The improvement of claim 1 wherein said locator portion is laterally displaced relative to said race portion, and said integrally formed locator and support rod race member further comprises a generally planar web portion extending therebetween.

3. The improvement of claim 2 wherein said integrally formed locator and support rod race member further comprises tab means spaced vertically downwardly from said web portion and extending laterally from said bearing surface beneath the top surface and beyond the edges of the slot to limit upward movement of said race portion relative thereto.

4. The improvement of claim 3 further comprising fastening means for attaching said locator portion to the range body.

5. The improvement of claim 4 wherein said integrally formed locator and support rod race member further comprises a projection extending downwardly from said web portion to abuttingly engage the top surface between said locator portion and said race portion, said projection being effective to urge said tab means upward into abutting engagement with the top surface.

6. The improvement of claim 4 wherein said fastening means comprises screw means extending through said locator portion to fasten said locator portion to the range body and wherein said integrally formed locator and support rod race member further comprises a projection extending downwardly from said web portion to abuttingly engage the top surface of the range body at a location generally intermediate said locator portion and said race portion, said projection being effective to urge said tab means upwardly into abutting engagement with the top surface when said screw means draws said locator portion tightly against said top surface thereby limiting relative vertical movement between said tab means and the top surface.

7. The improvement of claim 2 wherein said locator portion comprises lateral locator means comprising a vertically extending truncated cone shaped member, and vertical locator means comprising a flat formed at the base of said cone member and extending laterally therefrom to supportingly engage the cooktop when in its normal position, whereby the thickness of said flat establishes the vertical spacing between the cooktop and the range body when the cooktop is in its normal position, said thickness being greater than the thickness of said web portion.

8. The improvement of claim 7 wherein said integrally formed locator and support rod race member further comprises tab means spaced vertically downwardly from said web portion and extending laterally from said bearing surface beneath the top surface and beyond the edges of the slot to limit upward movement of said race portion relative thereto.

9. The improvement of claim 8 further comprising fastening means for attaching said locator portion to the range body.

10. The improvement of claim 9 wherein said integrally formed locator and support rod race member further comprises a projection extending downwardly from said web portion to abuttingly engage the top surface between said locator portion and said race portion, said projection being effective to urge said tab means upward into abutting engagement with the top surface.

11. The improvement of claim 9 wherein said fastening means comprises screw means extending through said locator portion to fasten said locator portion to the range body and wherein said integrally formed locator and support rod race member further comprises a projection extending downwardly from said web portion to abuttingly engage the top surface of the range body at a location generally intermediate said locator portion and said race portion, said projection being effective to urge said tab means upwardly into abutting engagement with the top surface when said screw means draws said locator portion tightly against said top surface thereby limiting relative vertical movement between said tab means and the top surface.

* * * * *